US008146548B2

(12) United States Patent
Yang et al.

(10) Patent No.: US 8,146,548 B2
(45) Date of Patent: Apr. 3, 2012

(54) CONTINUOUSLY VARIABLE VALVE LIFT DEVICE AND OPERATION LOGIC THEREOF

(75) Inventors: Jei Choon Yang, Yongin-si (KR); Eun Ho Lee, Hwaseong-si (KR); Young Hong Kwak, Suwon-si (KR); Ki Young Kwon, Seoul (KR); Jin Kook Kong, Suwon-si (KR); Soo Hyung Woo, Yongin-si (KR); Jin Soon Kim, Hwaseong-si (KR); Kyoung Joon Chang, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 337 days.

(21) Appl. No.: 12/506,889

(22) Filed: Jul. 21, 2009

(65) Prior Publication Data

US 2010/0077974 A1 Apr. 1, 2010

(30) Foreign Application Priority Data

Sep. 30, 2008 (KR) ..... 10-2008-0096177

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS

| | | | |
|---|---|---|---|
| 4,572,118 | A | 2/1986 | Baguena |
| 6,769,387 | B2 | 8/2004 | Hayman et al. |
| 2002/0100444 | A1 | 8/2002 | Todo et al. |

FOREIGN PATENT DOCUMENTS

| | | | |
|---|---|---|---|
| JP | 2000-337115 | A | 12/2000 |
| JP | 2005-282573 | A | 10/2005 |
| JP | 2006-258067 | A | 9/2006 |
| JP | 2006-077689 | A | 3/2008 |
| KR | 2002-0054774 | A | 7/2002 |

*Primary Examiner* — Ching Chang
(74) *Attorney, Agent, or Firm* — Morgan, Lewis & Bockius LLP

(57) ABSTRACT

A continuously variable valve lift device may include a vibration link having one end eccentrically and rotatably coupled to a rotation shaft, a rocker arm having a middle portion pivotally coupled to the other end of the vibration link, an advance lever having one end coupled to the one end of the rocker arm to select advance or delay, a swivel cam link having one end pivotally coupled to the other end of the rocker arm, and a swivel cam, one end of which is pivotally coupled to the other end of the swivel cam link and the other end of which is pivotally coupled to a stationary shaft to open and close a valve.

16 Claims, 9 Drawing Sheets

CONTINUOUSLY VARIABLE VALVE LIFT DEVICE AND OPERATION LOGIC THEREOF

CROSS-REFERENCE TO RELATED APPLICATION

The present application claims priority to Korean Patent Application Number 10-2008-0096177 filed Sep. 30, 2008, the entire contents of which application is incorporated herein for all purposes by this reference.

BACKGROUND OF THE INVENTION

1. Field of the Invention

The present invention relates to a continuously variable valve lift device, and more particularly, to a continuously variable valve lift device capable of reducing frictional force and improving its performance.

2. Description of Related Art

A four-stroke gasoline engine performs four strokes consisting of an intake stroke, compression stroke, power stroke and exhaust stroke. It also controls fuel flow in the cylinders and maintains an airtight space in the cylinders during the cycles.

As intake and exhaust valves are closed during the compression and power strokes, an airtight space is maintained within the cylinders. As the intake and exhaust valves are opened during the intake and exhaust strokes, fuel is introduced and combustion gas is exhausted.

Opening and closing of the intake and exhaust valves are performed by pushing ends of the valves with cams provided on a cam shaft, in which the driving force of a crank is transmitted to the cam shaft via a timing chain or timing belt.

A major factor determining the amount of intake or exhaust gas and the airtight space in the valve is a valve lift which can select acceleration or deceleration of a vehicle.

Recently, a continuously variable valve lift system has been developed and employed to vary opening period and time of intake and exhaust valves and valve lift of the intake and exhaust valves in order to improve thermal efficiency and output.

That is, the continuously variable valve lift system can optimize the opening time of the intake and exhaust valves and movement of the intake and exhaust valves such as valve lift in accordance with operational conditions of the engine.

Therefore, it can maximize the flow rate of the intake of air at acceleration or high speeds requiring high output, and minimize the effect of EGR (Exhaust Gas Recirculation) at deceleration or low speed to improve the fuel efficiency and reduce exhaust.

FIG. 1 shows a conventional continuously variable valve lift device.

The continuously variable valve lift device includes, as shown in FIG. 1, an eccentric cam shaft 10 coupled with an eccentric cam pushing a valve 1, an eccentric cam wheel 20 moved up and down by rotation of the eccentric cam shaft 10, a rocker arm 30 with a center portion rotatably coupled to an end of the eccentric cam wheel 20, a swivel link 40 coupled to one end of the rocker arm 30, a swivel cam 50 pushing the valve to open and close the valve, and a control link 60 connecting the other end of the rocker arm 30 with a control arm 61.

The operation of the conventional continuously variable valve lift system will now be described.

First of all, if the eccentric cam shaft 10 is rotated by the crank, the eccentric cam is rotated along the inner circumference of the eccentric cam wheel 20 by the eccentric cam shaft 10, and the eccentric cam wheel 20 is swiveled in a vertical direction along a certain track. The rocker arm 30 is swiveled in a vertical direction by the eccentric cam wheel 20 to swivel the control link 60 and the swivel link 40.

In this instance, when the swivel link 40 is lowered, the swivel cam 50 is rotated by the swivel link 40 to push the valve 1, so that the valve is opened or closed.

However, since the eccentric cam comes in contact with the inner circumference of the eccentric cam wheel 20 when the eccentric cam shaft 10 is rotated, the frictional force is significantly increased. There is a problem of wearing and noise occurring due to the frictional force.

Also, since the radio of gyration of the control arm 50 is separated from the eccentric cam shaft 10, it is different from the advance direction of the eccentric cam. Therefore, it is difficult to adjust the advance.

In addition, since the conventional continuously variable valve lift device has a complicated structure, much manufacturing expenses and times are needed, and thus its cost is increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve lift device capable of reducing a frictional force, improving its performance, and easily controlling an advance.

In an aspect of the present invention, the continuously variable valve lift device may include vibration link having one end eccentrically and rotatably coupled to a rotation shaft, a rocker arm having a middle portion pivotally coupled to the other end of the vibration link, an advance lever having one end coupled to the one end of the rocker arm to select advance or delay, a swivel cam link having one end pivotally coupled to the other end of the rocker arm, and a swivel cam, one end of which is pivotally coupled to the other end of the swivel cam link and the other end of which is pivotally coupled to a stationary shaft to open and close a valve.

A rotation angle of the one end of the rocker arm around the rotation shaft may be configured to be regulated by a controller.

The one end of the vibration link may include a wheel portion including an inner circumference and an outer circumference and one end of a roller link is connected to the rotation shaft and the other end thereof is slidably engaged to the inner circumference, a radius of the inner circumference being shorter than a length of the roller link.

The roller link may roll on the inner circumference of the vibration link by a roller formed on the other end of the roller link.

The one end of the vibration link may include a wheel portion including an inner circumference and an outer circumference and one ends of a plurality of roller link are connected to the rotation shaft and the other ends thereof are slidably engaged to the inner circumference, length of at least one roller link being larger than a radius of the inner circumference, wherein a roller is installed to the other end of each roller link.

The one end of the vibration link may include a wheel portion including an inner circumference and an outer circumference and, one ends of a plurality of roller links are connected to the rotation shaft and the other ends thereof are slidably engaged to the outer circumference, length of at least one roller link being larger than a radius of other roller links, wherein a roller is installed to the other end of each roller link.

The other end of the advance lever may be rotatably fixed to the stationary shaft.

A rotation axis of the rotation shaft may be disposed coaxially with that of the stationary shaft.

The one end of the roller link may be eccentrically mounted on a rotation axis of the stationary shaft.

The swivel cam may include a high lift profile and a low lift profile.

In another aspect of the present invention, an operation logic of a continuously variable valve lift device may include determining whether an advance lever is positioned at advance or delay, when a crank is rotated by an engine, rotating a rotation shaft in cooperation with the crank if a position of the advance lever is determined, advancing or delaying a vibration link, a rocker arm, a swivel cam link, and a swivel cam in cooperation with advance or delay movement of the advance lever around a stationary shaft if the rotation shaft is rotated, and opening or closing a valve in order to perform or prevent valve lift due to delay or advance movement of the swivel cam, wherein the vibration link is delayed or advanced by the roller link rolling on a circumference of the rotation shaft.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

A continuously variable valve lift device according to various embodiments of the present invention will be described with reference to FIGS. 2 to 9.

Figure 1:
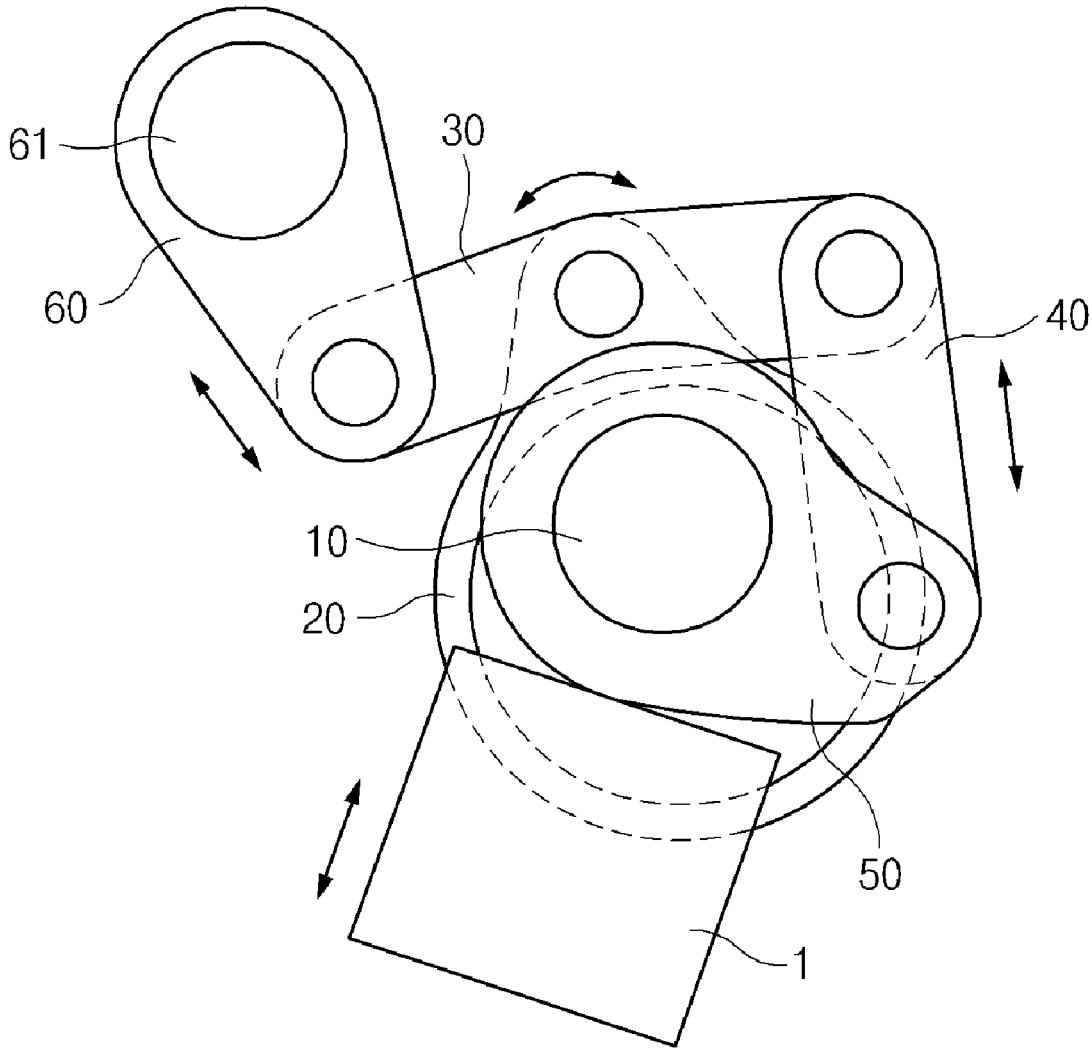
FIG. 1 (Prior Art)
FIG. 1 is a front view showing a continuously variable valve lift device according to the related art.
Figure 2:
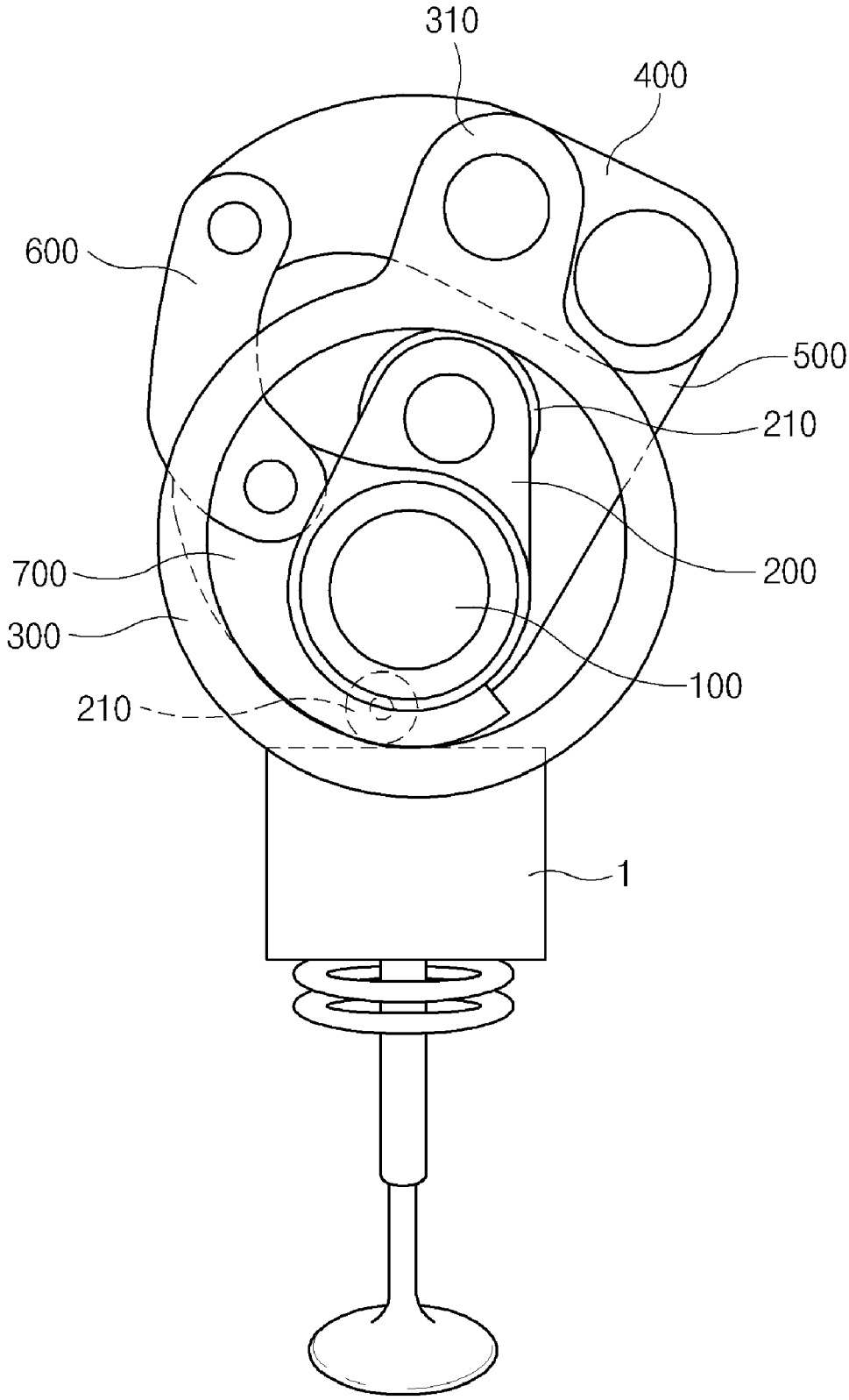
FIG. 2 is a front view showing an exemplary continuously variable valve lift device according to the present invention.
Figure 3:
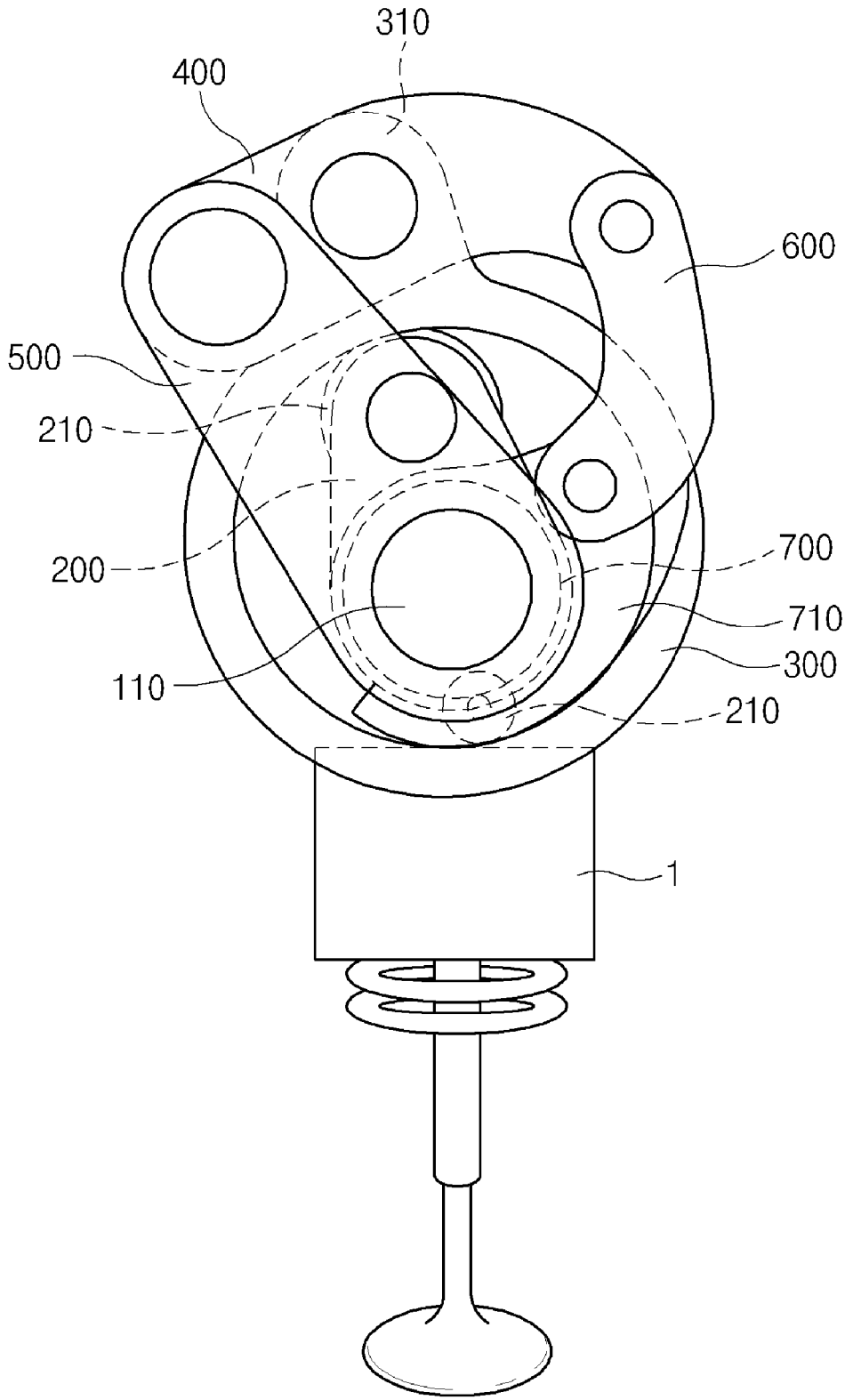
FIG. 3 is a rear view showing an exemplary continuously variable valve lift device according to the present invention.
Figure 4:
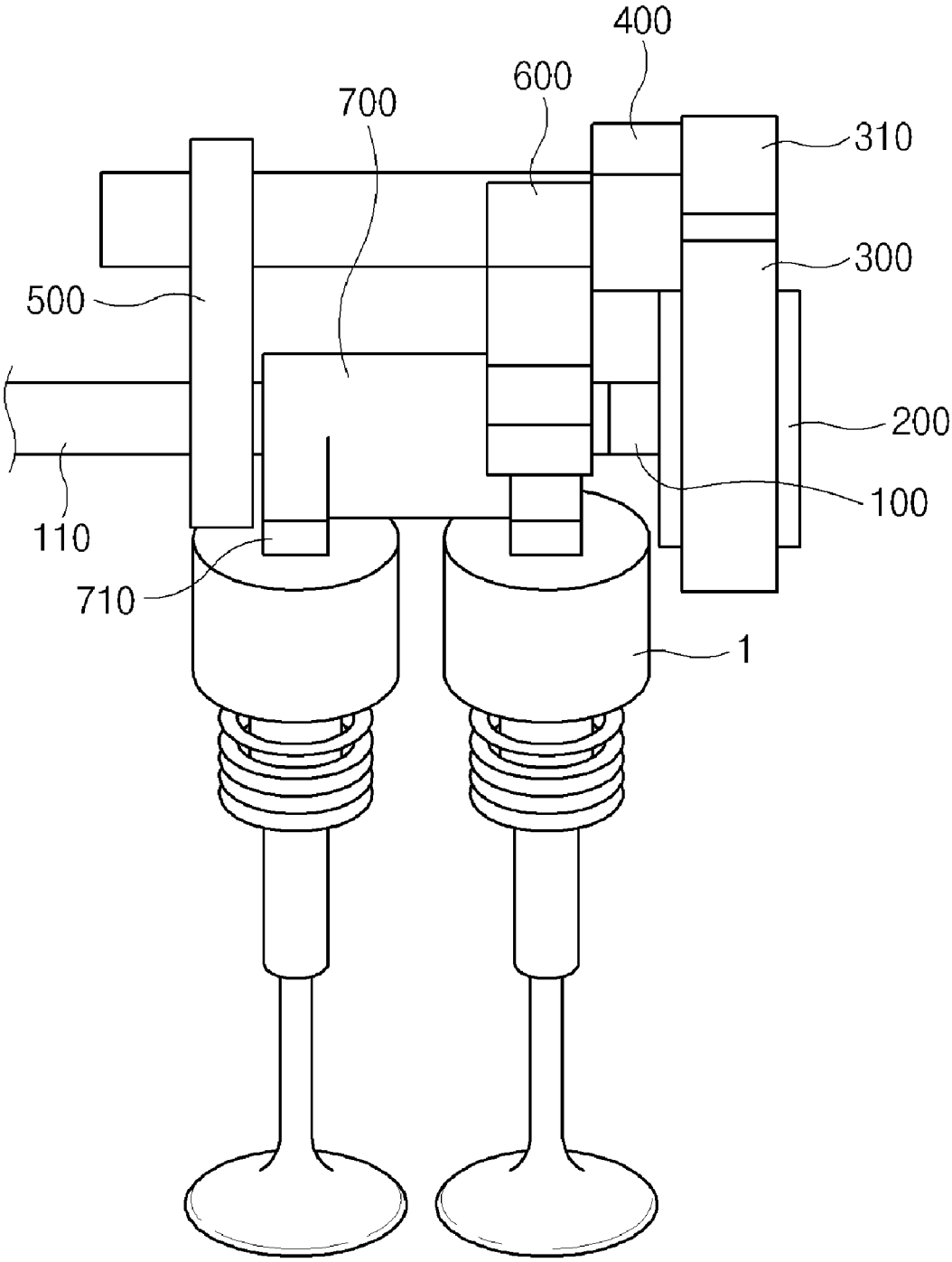
FIG. 4 is a side view showing an exemplary continuously variable valve lift device according to the present invention.

The continuously variable valve lift device according to the present invention includes, as shown in FIGS. 2 to 4, a rotation shaft 100 rotated by a crank which receives a driving force from an engine, a roller link 200 rotated by the rotation shaft 100, a vibration link 300 moved up and down by rotation of the roller link 200, a rocker arm 400 having a center portion coupled to the vibration link 300 and moved up and down by the vibration link 300, an advance lever 500 coupled to one end of the rocker arm 400 to select advance or delay, a swivel cam link 600 coupled to the other end of the rocker arm 400 and moved up and down by the rocker arm 400, and a swivel cam 700 pivoted around a stationary shaft 110 by the swivel cam link 600 to open and close a valve 1.

The vibration link 300 includes a wheel portion to receive the roller link 200 therein.

The rotation shaft 100 is coupled to a crank in such a way that the rotation shaft is rotated in cooperation with the crank, and the roller link 200 is movably mounted on the inner circumference of a rotation shaft 100.

The length of the roller link 200 is longer than a radius of the wheel portion of the vibration link.

The stationary shaft 110 is provided on one side of the rotation shaft 100, and the rotation shaft 100 is disconnected from the stationary shaft 110, while a rotation axis of the rotation shaft 100 coincides with the stationary shaft 110, so that the rotation of the rotation shaft 100 is not transmitted to the stationary shaft 100.

The advance lever 500 and the swivel cam 700 are rotatably connected to the circumference of the stationary shaft 110.

More specifically, the advance lever 500 and the swivel cam 700 are fixed to the same shaft, that is, the stationary shaft 110, thereby increasing the advance effect and accurately adjusting the advance by controlling the rotational position of the advance lever 500.

When the crank is rotated, the rotation shaft 100 and the roller link 200 are cooperatively rotated, while the stationary shaft 110, the advance lever 500 and the swivel cam 700 are maintained in a stationary state.

The roller link 200 is eccentrically mounted on the rotation axis of the rotation shaft 100 so as to move the vibration link 300 up and down. The end of the roller link 200 rolls on the inner circumference of the vibration link 300 to move the vibration link 300 in a vertical direction. The roller link 200 is provided on its end with at least one roller 210 so as to significantly reduce frictional force between the roller link 200 and the vibration link 300, and the roller 210 rolls on the inner circumference of the vibration link 300.

More specifically, when the roller link 200 is rotated, the roller 210 revolves and is turned around the inner circumference of the vibration link 300, and thus the roller 210 rolls on the inner circumference of the vibration link 300 to significantly reduce the frictional force and thus decrease wear and noise.

The vibration link 300 includes the wheel portion in a ring shape to support the roller 210 of the roller link 200 by using its inner circumference. The vibration link 300 includes a boss 310 formed on the outer circumference to fix the rocker arm 400.

The center portion of the rocker arm 400 is pivotally fixed to the boss 310. One end of the rocker arm 400 which is adjacent to the boss 320 is coupled to the end of the advance lever 500, and the other end is coupled to the end of the swivel cam link 600.

That is, the other end of the rocker arm 400 is moved up and down in cooperation with the vibration link 300 around one end thereof which is coupled to the advance lever 500.

The advance lever 500 is a lever that selects the ignition advance or the ignition delay, and has an end rotatably coupled to the end of the rocker arm 400 and the other end rotatably fixed to the stationary shaft 110 while enclosing the circumference thereof.

The end of the advance lever 500 coupled to the rocker arm 400 is connected to an operation lever or switch which directly controls the advance lever 500, and externally operates the advance lever 500 by using the operation lever or switch.

The swivel cam link 600 rotates the swivel cam 700 around the stationary shaft 110. One end of the swivel cam link 600 is rotatably coupled to the other end of the rocker arm 400, and the other end is rotatably coupled to the cam portion 710 of the swivel cam 700, so that the swivel cam 600 is moved up and down by vertical movement of the rocker arm 400.

The swivel cam 700 opens and closes the valve, and is rotatably coupled to the stationary shaft 110 while enclosing the circumference of the stationary shaft 110. The other end of the swivel cam link 600 is rotatably fixed to the cam portion 710 formed on the side portion of the swivel cam 700.

The operation logic of the continuously variable valve lift device according to the present invention will now be described with reference to FIGS. 5 to 7.

The operation logic includes steps for determining whether the advance lever 500 is positioned at advance or delay, when the crank is rotated by the engine, rotating the rotation shaft 120 in cooperation with the crank if the position of the advance lever 500 is determined, advancing or delaying the vibration link 300, the rocker arm 400, the swivel cam link 600, and the swivel cam 700 in cooperation with advance or delay movement of the advance lever 500 around the stationary shaft 110 if the rotation shaft 120 is rotated, and opening or closing the valve 1 in order to perform or prevent valve lift due to delay or advance movement of the swivel cam 700. A vehicle travels at acceleration/high speed or deceleration/low speed.

The operation logic of the continuously variable valve lift device will now be described with reference to FIG. 5.

Figure 5:
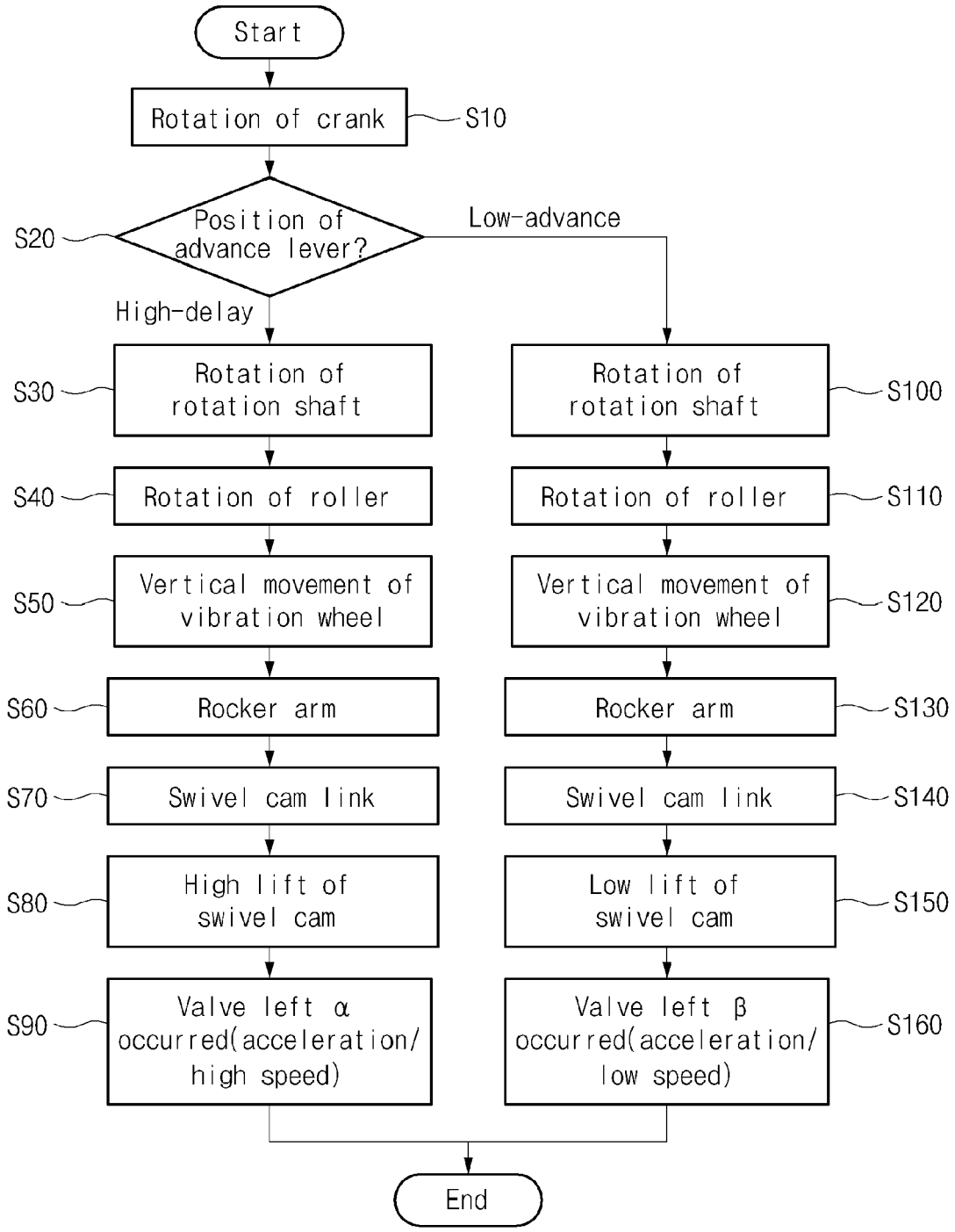
FIG. 5 is a flowchart showing the operation logic of an exemplary continuously variable valve lift device according to the present invention.

First of all, as shown in FIG. 5, when the engine operates, the crank is rotated (S10), and an ECU determines whether the advance lever 500 is positioned at advance or delay (S20).

That is, the ECU determines whether the advance lever 500 is located at the delay position or the advance position.

Figure 6:
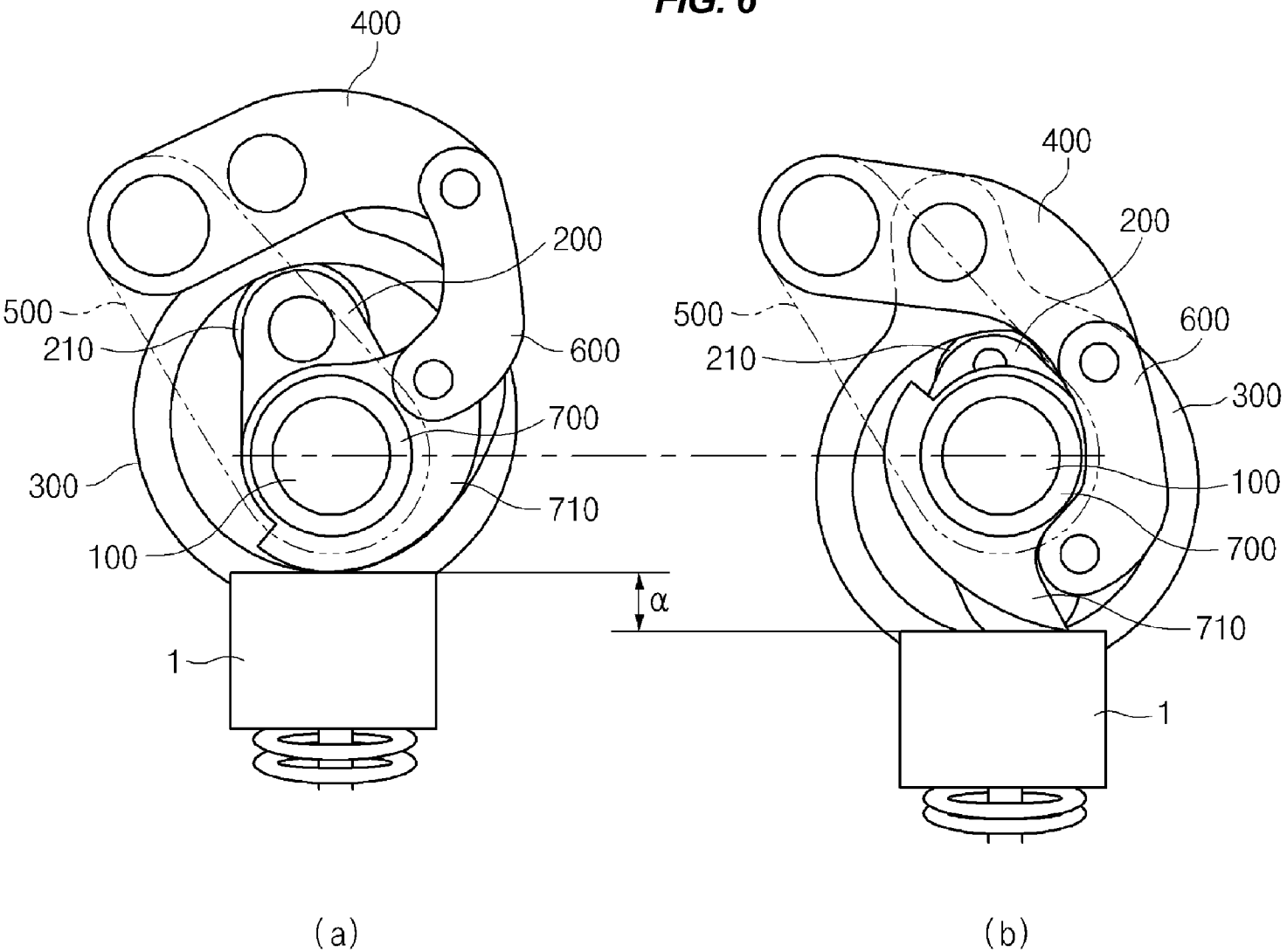
FIG. 6 is a view showing the delay lift state of an exemplary continuously variable valve lift device according to the present invention.

If the advance lever 500 is located at the delay position, as shown in FIG. 6, the rotation shaft 100 is rotated by the crank (S30), and thus the roller link 200 is rotated around the inner circumference of the vibration link 300 (S40).

At that time, the roller link 200 is rotated in roll contact along the inner circumference of the vibration link 300 by the roller 210 to minimize the frictional force (see FIG. 6*a*).

The vibration link 300 is moved up and down by rotation of the roller link 200 (S50), and the rocker arm 400 is moved up and down around the advance lever 500 (S60).

The swivel cam link 600 is moved up and down in cooperation with vertical movement of the rocker arm 400 (S70), and thus the swivel cam 700 is pivoted around the stationary shaft 110 to be highly lifted (S80).

The valve 1 is largely opened and closed by the high lift of the swivel cam 700 to generate a valve lift $\alpha$ (S90), so that a vehicle can accelerate or travel at a high speed (see FIG. 6*b*).

Figure 7:
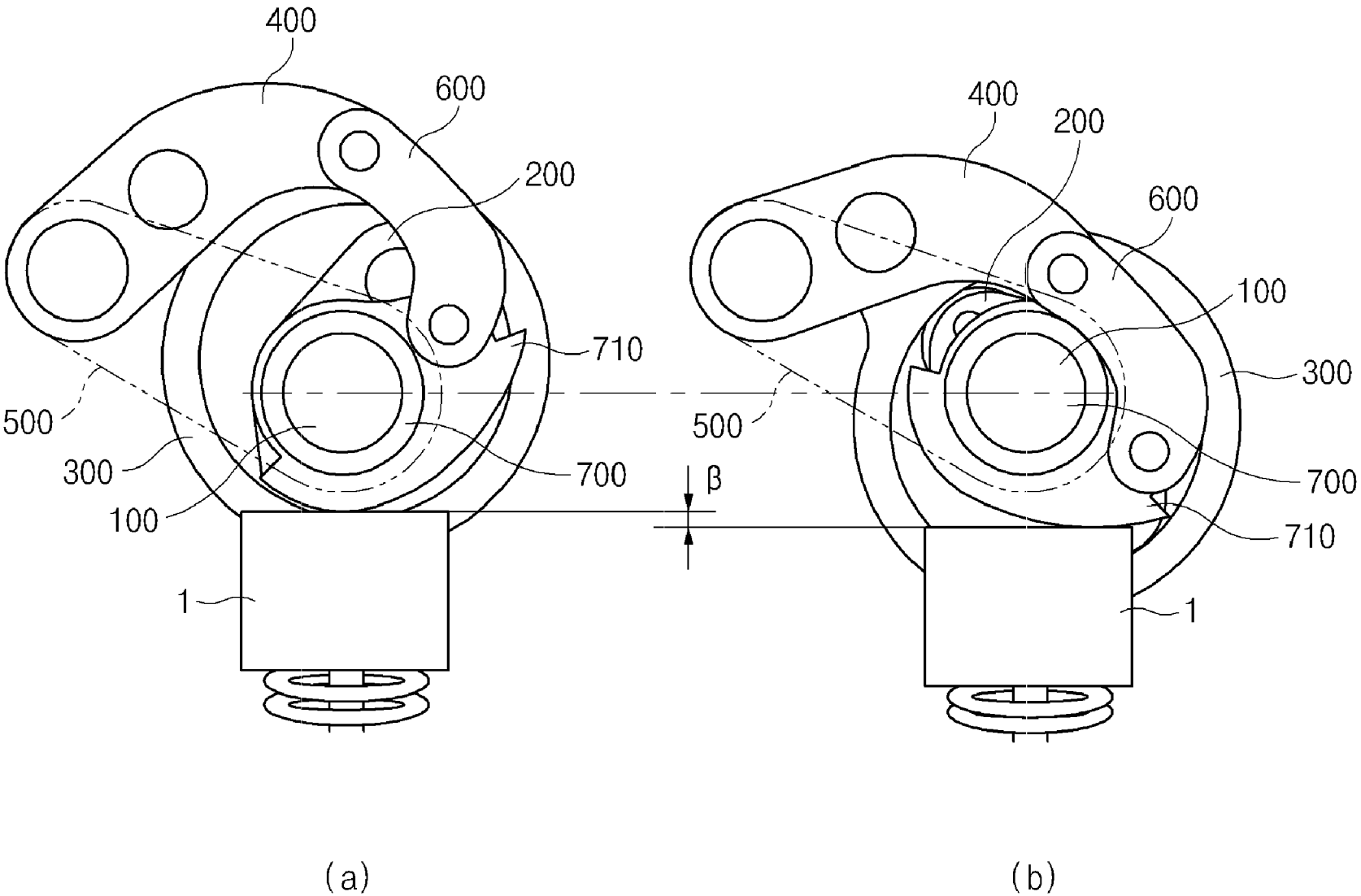
FIG. 7 is a view showing the advance lift state of an exemplary continuously variable valve lift device according to the present invention.

If the advance lever 500 is located at the advance position, as shown in FIG. 7, the rotation shaft 100 is rotated by the crank (S100), and thus the roller link 200 is rotated around the inner circumference of the vibration link 300 (see FIG. 7*a*).

At that time, the roller link 200 is rotated in roll contact along the inner circumference of the vibration link 300 by the roller (S110).

The vibration link 300 is moved up and down by rotation of the roller link 200 (S120), and the rocker arm 400 is moved up and down around the advance lever 500 (S130).

The swivel cam link 600 is moved up and down in cooperation with vertical movement of the rocker arm 400 (S140), and thus the swivel cam 700 is pivoted around the stationary shaft 110 to be lowly lifted (S150).

The valve 1 is opened slightly and closed by the low lift of the swivel cam 700 to generate a valve lift $\beta$ (S160), so that a vehicle travels at deceleration or low speed (see FIG. 7*b*).

Figure 8:
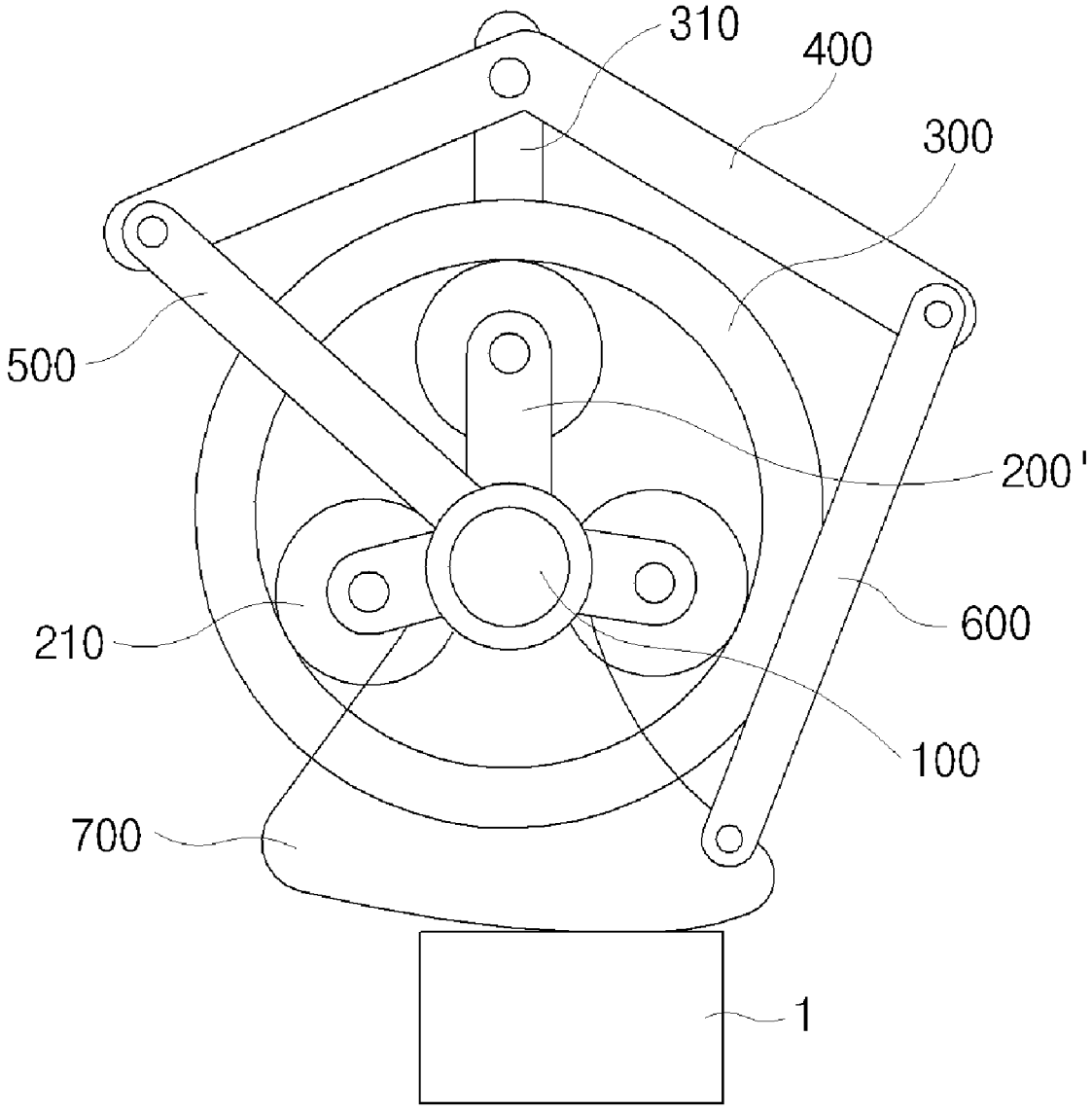
FIG. 8 is a view showing an exemplary roller link according to the present invention.

FIG. 8 shows a roller link according to various embodiments of the present invention. A roller link 200' of such embodiments includes at least three rollers 210 mounted on the circumference of the roller link 200' at regular intervals, so that three rollers 210 roll on the inner circumference of the vibration link 300 to obtain smooth rotation force of the roller link 200'.

Figure 9:
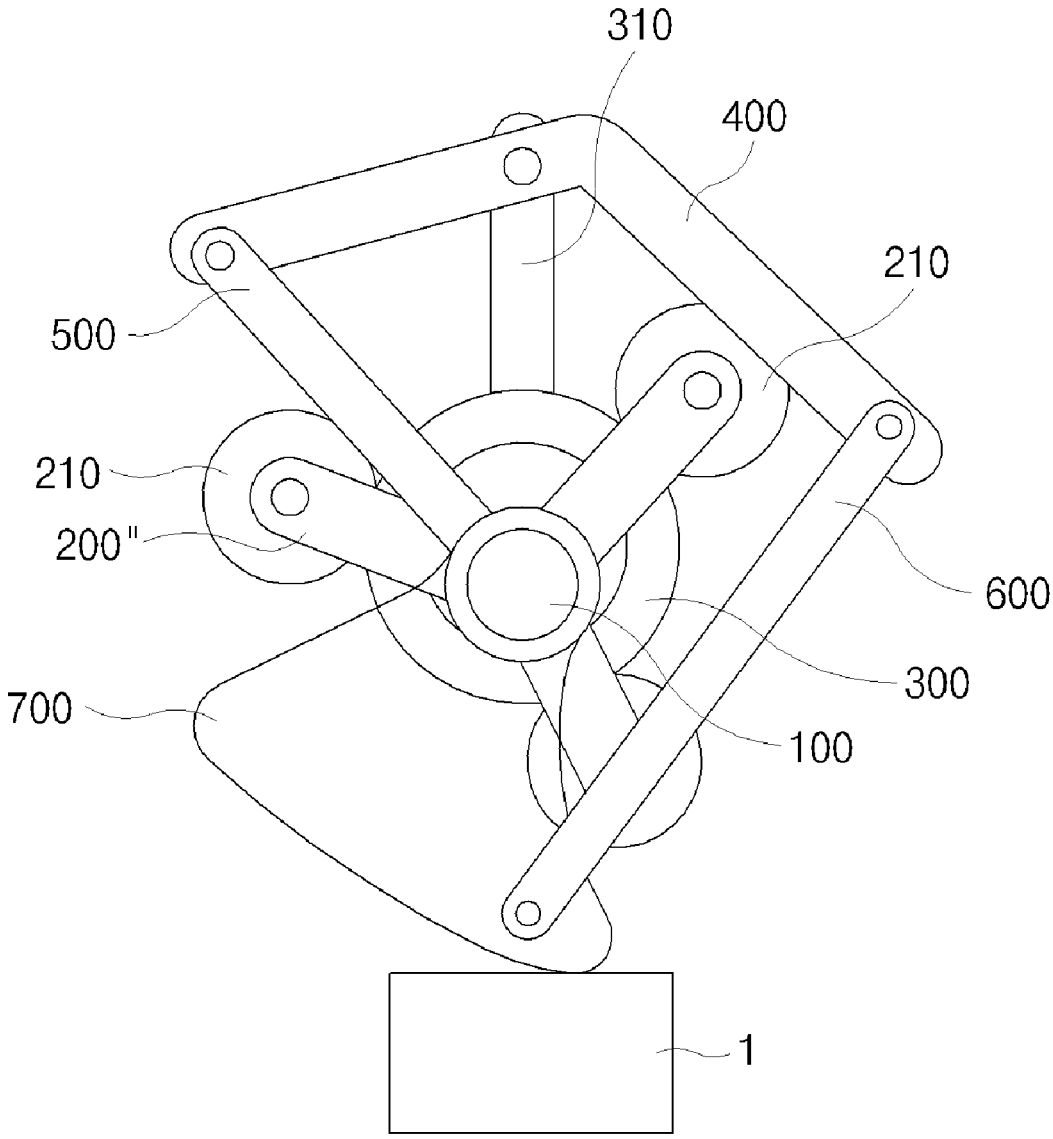
FIG. 9 is a view showing another exemplary roller link according to the present invention.

FIG. 9 shows a roller link according to other embodiments of the present invention. A roller link 200" of such embodiments includes a roller mounted on an end thereof in such a way that the roller 210 rolls on the outer circumference of the vibration link 300.

For convenience in explanation and accurate definition in the appended claims, the terms "up", "down", "outer", and "inner" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift device comprising:

a vibration link having one end eccentrically and rotatably coupled to a rotation shaft, wherein a roller link mounted on the rotation shaft rolls on the vibration link;

a rocker arm having a middle portion pivotally coupled to the other end of the vibration link;

an advance lever having one end coupled to the one end of the rocker arm to select advance or delay;

a swivel cam link having one end pivotally coupled to the other end of the rocker arm; and a swivel cam, one end of which is pivotally coupled to the other end of the swivel cam link and the other end of which is pivotally coupled to a stationary shaft to open and close a valve.

2. The continuously variable valve lift device as claimed in claim 1, wherein a rotation angle of the one end of the rocker arm around the rotation shaft is configured to be regulated by a controller.

3. The continuously variable valve lift device as claimed in claim 1, wherein the one end of the vibration link comprises a wheel portion including an inner circumference and an outer circumference and one end of a roller link is connected to the rotation shaft and the other end thereof is slidably engaged to the inner circumference, a radius of the inner circumference being shorter than a length of the roller link.

4. The continuously variable valve lift device as claimed in claim 3, wherein the roller link rolls on the inner circumference of the vibration link by a roller formed on the other end of the roller link.

5. The continuously variable valve lift device as claimed in claim 1, wherein the one end of the vibration link comprises a wheel portion including an inner circumference and an outer circumference and one ends of a plurality of roller link are connected to the rotation shaft and the other ends thereof are slidably engaged to the inner circumference, length of at least one roller link being larger than a radius of the inner circumference.

6. The continuously variable valve lift device as claimed in claim 5, wherein the roller links roll on the inner circumference of the vibration link by a roller formed on the other end of each roller link.

7. The continuously variable valve lift device as claimed in claim 1, wherein the one end of the vibration link comprises a wheel portion including an inner circumference and an outer circumference and, one ends of a plurality of roller links are connected to the rotation shaft and the other ends thereof are slidably engaged to the outer circumference, length of at least one roller link being larger than a radius of other roller links.

8. The continuously variable valve lift device as claimed in claim 7, wherein a roller is installed to the other end of each roller link.

9. The continuously variable valve lift device as claimed in claim 8, wherein the roller links roll on the outer circumference of the vibration link by a roller formed on the other end of each roller link.

10. The continuously variable valve lift device as claimed in claim 1, wherein a rotation axis of the rotation shaft is disposed co-axially with that of the stationary shaft.

11. The continuously variable valve lift device as claimed in claim 1, wherein the swivel cam comprises a high lift profile and a low lift profile.

12. A passenger vehicle comprising the continuously variable valve lift device as claimed in claim 1.

13. The operation logic as claimed in claim 1, wherein the stationary shaft is a cam shaft.

14. An operation logic of a continuously variable valve lift device comprising:

determining whether an advance lever is positioned at advance or delay, when a crank is rotated by an engine;

rotating a rotation shaft in cooperation with the crank if a position of the advance lever is determined;

advancing or delaying a vibration link, a rocker arm, a swivel cam link, and a swivel cam in cooperation with advance or delay movement of the advance lever around a stationary shaft if the rotation shaft is rotated wherein a roller link mounted on the rotation shaft rolls on the vibration link; and opening or closing a valve in order to perform or prevent valve lift due to delay or advance movement of the swivel cam.

15. The operation logic as claimed in claim 14, wherein the vibration link is delayed or advanced by rotation of the roller link rolling on a circumference of the rotation shaft.

16. The operation logic as claimed in claim 14, wherein the stationary shaft is a cam shaft.

* * * * *